US006604540B2

(12) United States Patent
Kuriyama et al.

(10) Patent No.: US 6,604,540 B2
(45) Date of Patent: Aug. 12, 2003

(54) GAS CONTROL VALVE IN WATER HEATER

(75) Inventors: Tatsuo Kuriyama, Nagoya (JP); Atsushi Tanahashi, Nagoya (JP)

(73) Assignee: Paloma Industries, Limited, Aichi (JP)

( * ) Notice: Subject to any disclaimer, the term of this patent is extended or adjusted under 35 U.S.C. 154(b) by 111 days.

(21) Appl. No.: 09/809,415

(22) Filed: Mar. 15, 2001

(65) Prior Publication Data

US 2001/0022190 A1 Sep. 20, 2001

(30) Foreign Application Priority Data

Mar. 16, 2000 (JP) ..... 2000-073750

(51) Int. Cl.[7] ..... F23D 5/16
(52) U.S. Cl. ..... 137/66
(58) Field of Search ..... 137/66

(56) References Cited

U.S. PATENT DOCUMENTS 4,422,844 A 12/1983 Graham et al. ..... 431/72
4,640,676 A 2/1987 Katchka et al. ..... 431/54
4,975,043 A 12/1990 Katchka et al. ..... 431/54
5,326,029 A 7/1994 Schultz ..... 236/68 D
5,407,128 A 4/1995 Schultz ..... 236/68 D
5,484,103 A 1/1996 Schultz ..... 236/68 D
5,967,766 A * 10/1999 Katchka ..... 137/66

* cited by examiner

*Primary Examiner*—Gerald A. Michalsky
(74) *Attorney, Agent, or Firm*—Pearson & Pearson, LLP

(57) ABSTRACT

A gas control valve is provided with a unipolar overheat prevention terminal of which the connection structure is simplified in a magnetic circuit. In a flame-retention, storage type closed vessel gas water heater for automatically controlling the temperature of hot water in a tank to a desired level, the unipolar overheat prevention terminal 7 is mounted in the main body of an ignition/extinction unit A as held with a retaining projection 15 provided integrally on a cover 14 of the ignition/extinction unit so that it can hardly be detached while being separated from a gas shut off magnetic valve MV mounted at the upstream side of a gas flow passage 1. A burner flame detecting thermocouple TC and the gas shut off magnetic valve MV in the magnetic circuit are connected to each other by the unipolar overheat prevention terminal 7.

2 Claims, 5 Drawing Sheets

GAS CONTROL VALVE IN WATER HEATER

BACKGROUND OF THE INVENTION

1. Field of the Invention

The present invention relates to a gas control valve in a water heater and particularly to the connection structure of a unipolar overheat prevention terminal provided in the magnetic circuit of such a gas control valve.

2. Description of Related Art

An overheat prevention terminal in the magnetic circuit of a gas control valve in a storage type closed vessel gas water heater, for example, is generally mounted together with a thermocouple to the joint of a magnetic valve. More specifically, as shown in FIGS. 7 and 8, the joint 3*a* of the magnetic valve MV has an insertion recess 13 provided therein. The overheat prevention terminal 7 of bipolar type is fitted into the insertion recess 13 and secured with a retaining ring 15*a* before screwing a thermocouple TC on the recess 13.

However, for mounting the bipolar overheat prevention terminal 7 to the joint 3*a* of the magnetic valve MV, its insertion recess 13 has to be provided in the joint 3*a* which thus becomes bulky. Such a large joint is required and system body is made larger. Also, as the retaining ring 15*a* is used for anchoring the bipolar overheat prevention terminal 7, such problem or the like is caused that the number of components and thus the overall cost increase.

SUMMARY OF THE INVENTION

It is hence an object of the present invention to solve above-mentioned problems providing a gas control valve in a water heater which has a unipolar overheat prevention terminal provided between a burner flame detecting thermocouple and a gas shut off magnetic valve in the magnetic circuit.

For achieving the above object of the present invention, a gas control valve in a water heater as defined in claim 1 is characterized by a unipolar overheat prevention terminal provided between a burner flame detecting thermocouple and a gas shut off magnetic valve in the magnetic circuit.

The gas control valve in a water heater may be modified wherein the unipolar overheat prevention terminal is mounted in the main body of an ignition/extinction unit.

The gas control valve in a water heater may be modified wherein the unipolar overheat prevention terminal is supported by a retaining projection provided integrally on a cover of an ignition/extinction unit so that the unipolar overheat prevention terminal can hardly be detached.

As the gas control valve in a water heater has the unipolar overheat prevention terminal provided between the burner flame detecting thermocouple and the gas shut off magnetic valve in the magnetic circuit, the connection structure of the unipolar overheat prevention terminal can significantly be simplified. As a result, the unipolar overheat prevention terminal can be joined to the magnetic valve by only screwing the thermocouple.

As the gas control valve in a water heater allows the unipolar overheat prevention terminal to be mounted in the main body of the ignition/extinction unit, the joint of the magnetic valve remains smaller than that of any conventional valve. As the result, the system body can be made smaller.

As the gas control valve in a water heater allows the unipolar overheat prevention terminal to be supported by the retaining projection provided integrally on the cover of the ignition/extinction unit so that the terminal can hardly be detached, the unipolar overheat prevention terminal can remain connected even if the thermocouple is not connected. Accordingly, the connection of the unipolar overheat prevention terminal will be carried out with ease and improved in the working efficiency.

DETAILED DESCRIPTION OF THE PREFERRED EMBODIMENT

Figure 1:
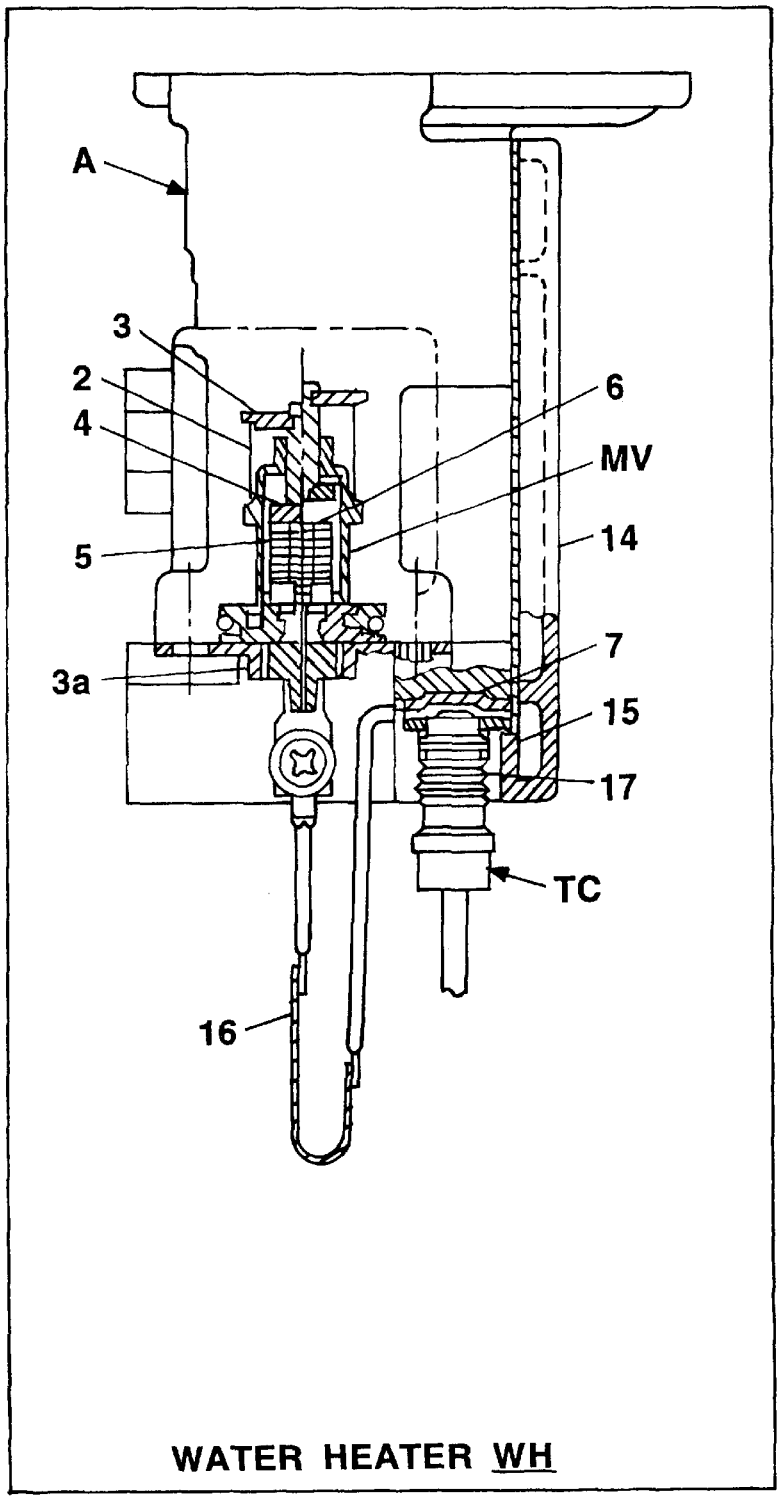
FIG. 1 is a longitudinally cross sectional side view showing one example of a primary part of a gas control valve in a water heater according to the present invention.
Figure 2:
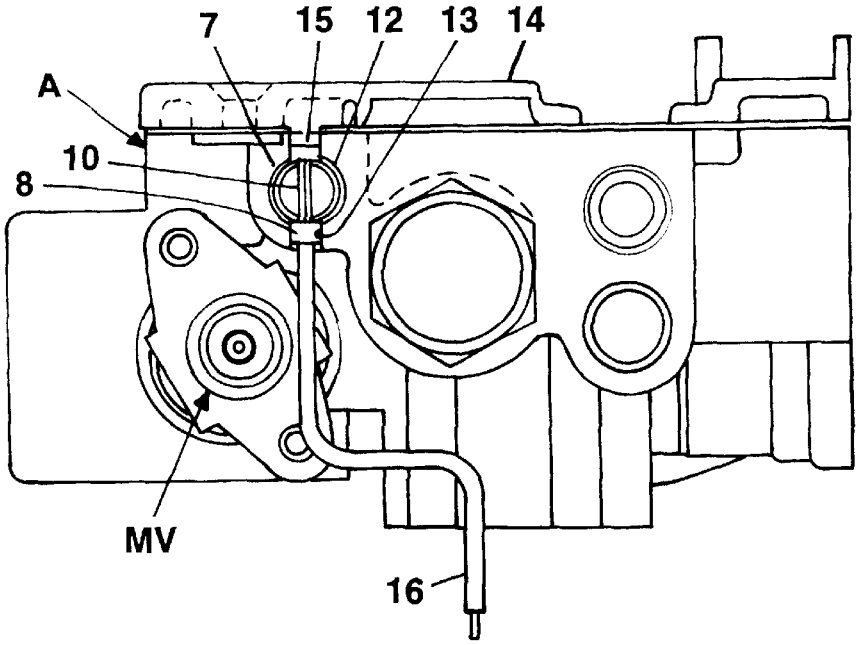
FIG. 2 is a bottom view of the entire arrangement.
Figure 6:
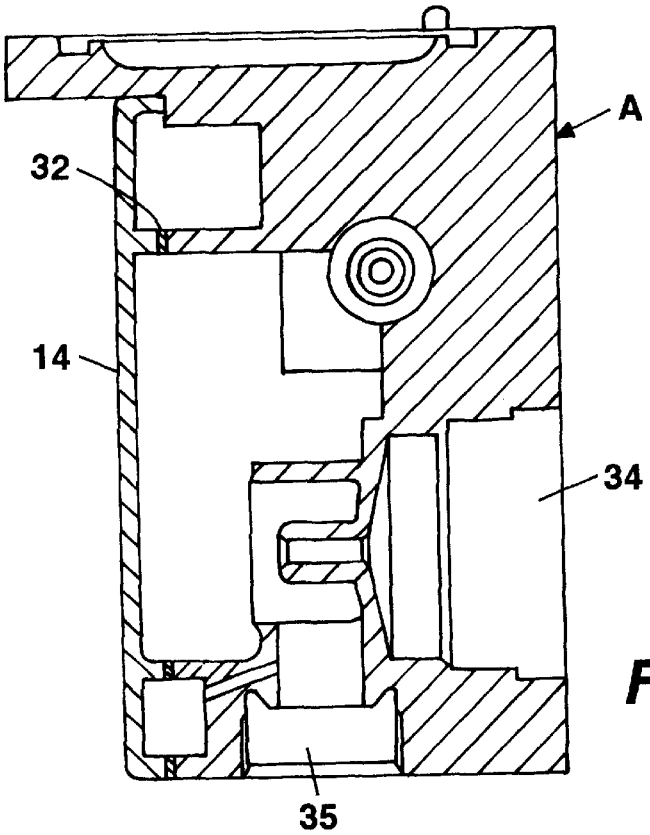
FIG. 6 is a cross sectional view of the ignition/extinction unit only taken along the line Y—Y of FIG. 3.

For further clarifying the arrangement and operation of the present invention, one preferred embodiment of the gas control valve in a water heater WH according to the present invention will be described referring to the relevant drawings hereinafter. Like components are denoted by like numerals as those of the above conventional one for ease of the description.

The embodiment of the gas control valve of the invention is particularly designed for use in a storage type closed vessel gas water heater WH of flame-retention for automatically controlling the temperature of hot water in a tank T to a desired level. As shown in FIGS. 1 to 6, denoted by MV is a gas shut off magnetic valve (a solenoid safety valve apparatus) in the magnetic circuit of the gas control valve. More specifically, the gas shut off magnetic valve MV is located at the upstream side of a gas flow passage 1 and includes a gas valve 3 remaining to be pressed by a spring 2 in its closing direction and an attraction plate 4 provided integral with the gas valve 3 facing to each other for movement to and from an attracting surface 6 of a solenoid coil 5 with no use of a large sized joint 3*a* which is commonly used in a conventional valve.

Figure 4:
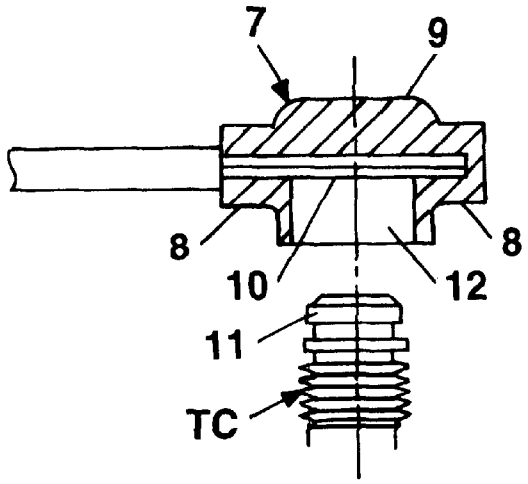
FIG. 4 illustrates a cross sectional view of a unipolar overheat prevention terminal and a front view of a part of a burner flame detecting thermocouple.
Figure 5:
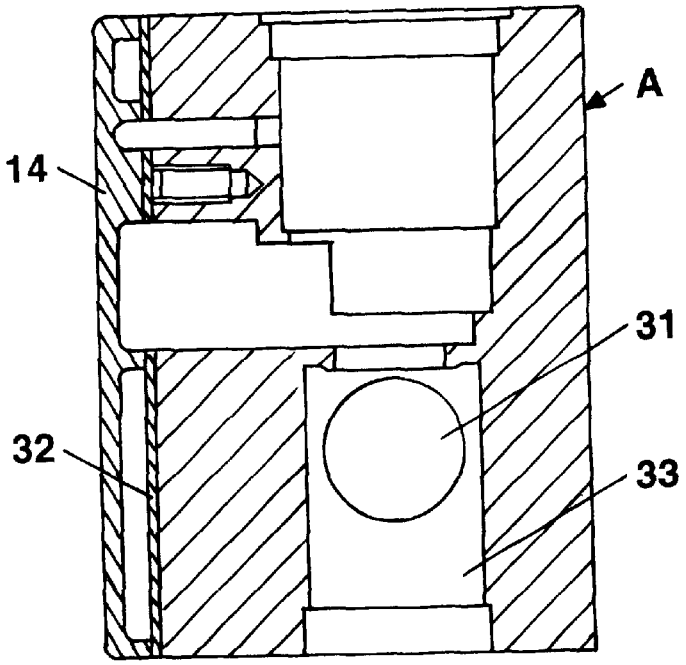
FIG. 5 is a cross sectional view of an ignition/extinction unit only taken along the line X—X of FIG. 3.
Figure 7:
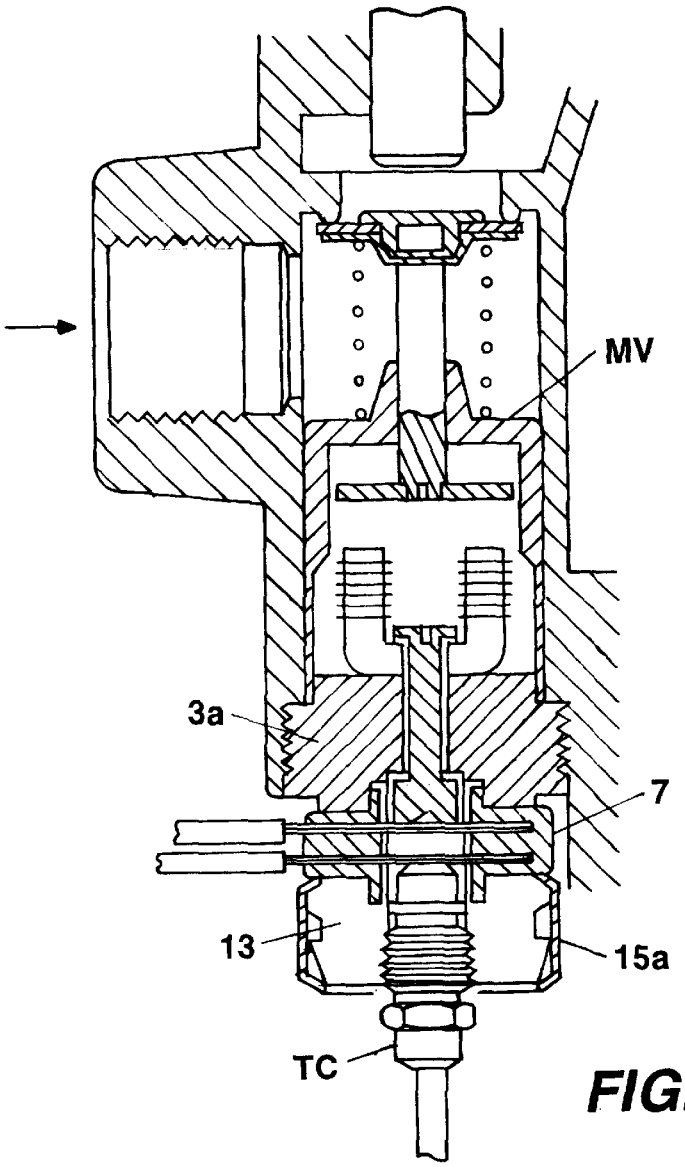
FIG. 7 (PRIOR ART)
FIG. 7 is a longitudinally cross sectional front view showing a primary part of a conventional gas control valve.
Figure 8:
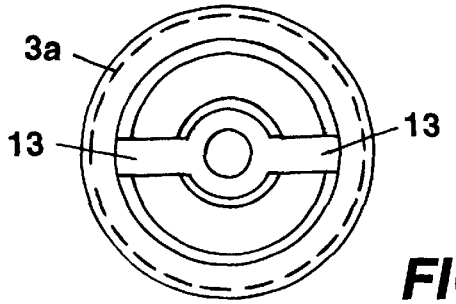
FIG. 8 (PRIOR ART)
FIG. 8 is a bottom view of a joint of the conventional gas control valve only.

Denoted by 7 is a unipolar overheat prevention terminal which comprises, as shown in FIG. 4, an insulating terminal body 9 having two support projections 8 provided on both ends thereof and a lead 10 inserted into and fixed to the insulating terminal body 9. The insulating terminal body 9 also has an insertion tube portion 12 provided therein at right angles to the lead 10 for accepting the contact head 11 of a burner flame detecting thermocouple TC which will be described later.

The unipolar overheat protection terminal 7 is located substantially close to the above-mentioned magnetic valve MV in an ignition/extinction unit A. More specifically, the two support projections 8 of the unipolar overheat prevention terminal 7 are accommodated in corresponding support recesses 13 provided in a main body of the ignition/extinction unit A and covered with a cover 14 of the ignition/extinction unit A which has a retaining projection 15 integrally provided thereon for supporting and inhibiting the unipolar overheat prevention terminal 7 from accidentally removing from the ignition/extinction unit A. Also, shown are a packing 32 mounted between the main body of the ignition/extinction unit A and the cover 14, an accommodating section 33 for above-mentioned the gas shut off magnetic valve MV of the main body of the ignition/extinction unit A, an accommodating section 34 for a snap valve not shown, and a main gas outlet 35.

The lead 10 of the unipolar overheat prevention terminal 7 is electrically connected by a lead 16 to the solenoid coil 5 of the above-mentioned magnetic valve MV. The negative of the lead not shown is grounded on the main body of the ignition/extinction unit A.

Denoted by TC is a burner flame detecting thermocouple which is screwed into a female thread 17 provided at the body 13*a* of the support recesses 13 of the unipolar overheat prevention terminal 7 so as its contact head 11 comes into direct contact with the lead 10. The thermocouple TC is electrically connected by the unipolar overheat prevention terminal 7 to the gas shut off magnetic valve MV as a member of the magnetic circuit.

Accordingly, the unipolar overheat prevention terminal 7 provided between the gas shut off magnetic valve MV and the burner flame detecting thermocouple TC in the magnetic circuit is minimized in the construction and thus contributes to the minimum size and the ease of the assembly of the main body of the ignition/extinction unit A. Namely, the unipolar overheat prevention terminal 7 is mounted in the main body of the ignition/extinction unit A as separated from the gas shut off magnetic valve MV mounted at the upstream side of the gas flow passage 1 and arranged connectable with the burner flame detecting thermocouple TC, whereby the burner flame detecting thermocouple TC and the gas shut off magnetic valve MV in the magnetic circuit can be connected to each other by the unipolar overheat prevention terminal 7.

Figure 3:
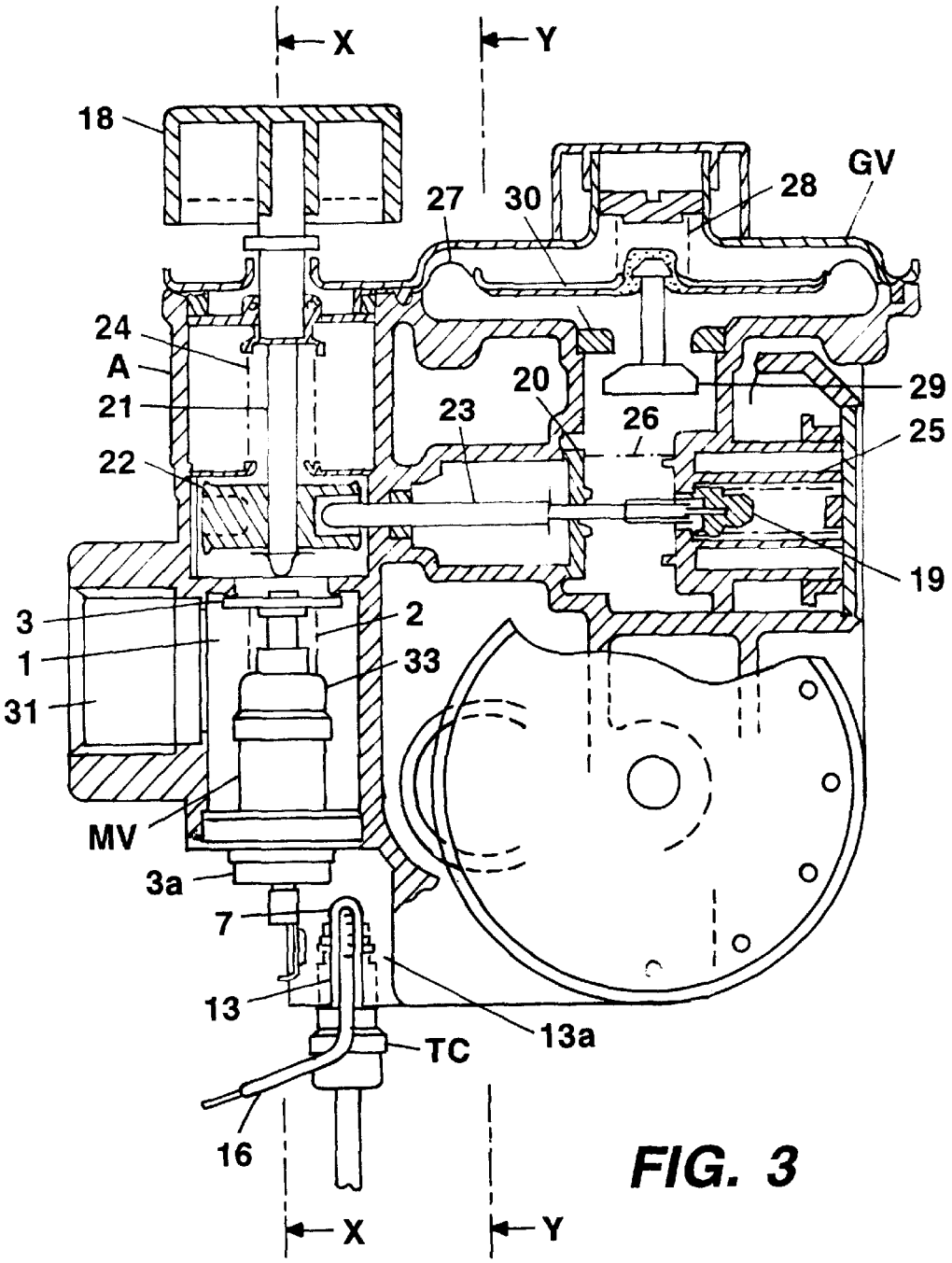
FIG. 3 is a longitudinally cross sectional front view of the entire arrangement.

The ignition/extinction unit A may be arranged, for example, as shown in FIG. 3, for opening a pilot valve 19, a gas valve 3, and a main valve 20 in this order with an ignition knob 18 being turned and pushed. More particularly, as the ignition knob 18 is turned, its ignition operating shaft 21 drives a cam 22, which is fixedly mounted to the shaft 21 for turning together, to move forward and backward a valve pin 23, on which the pilot valve 19 and the main valve 20 are mounted, for opening the pilot valve 19 and then the main valve 20 at a desired delay of time. Simultaneously, the gas valve 3 is attracted and actuated for opening and retained by the action of electromotive force generated by the burner flame detecting thermocouple TC. Also, provided are a return spring 24 for returning the ignition operating shaft 21 to its original position, a spring 25 pressing the pilot valve 19 in its closing position, a spring 26 pressing the main valve 20 in its closing position, and a gas governor GV. When a diaphragm 27 is pressed by the secondary gas pressure, it moves together with a governor valve 29 until it is balanced with the pressing force of an adjusting pressure spring 28. The movement of the governor valve 29 to and from a valve seat 30 determines the opening of the gas passage. Accordingly, even if a change in the pressure of supplied gas occurs at the upstream, the amount of gas in use at the downstream can be maintained to a constant level. Then, the gas pressure remains stable. Denoted by 31 is a gas inlet.

It would be understood that while the present invention is not limited to the preferred embodiment described above, various changes and modifications may be made without departing from the scope of the present invention.

As set forth above, the gas control valve in a water heater WH according to the present invention has the unipolar overheat prevention terminal provided between the burner flame detecting thermocouple and the gas shut off magnetic valve in the magnetic circuit. Accordingly, the connection structure of the unipolar overheat prevention terminal can be simplified as well as the ignition/extinction unit can be minimized in the size and facilitated in the assembling work. Also, the number of the components will be reduced thus significantly decreasing the overall cost as compared with any conventional one.

What is claimed is:

1. A gas control valve in a water heater characterized by a unipolar overheat prevention terminal provided between a burner flame detecting thermocouple and a gas shut off magnetic valve in a magnetic circuit; and said unipolar overheat prevention terminal is supported by a retaining projection provided integrally on a cover of an ignition/extinction unit so that the unipolar overheat prevention terminal can hardly be detached.

2. The gas control valve in a water heater according to claim 1, wherein the unipolar overheat prevention terminal is mounted in a main body of said ignition/extinction unit.

* * * * *